US012507805B2

(12) United States Patent
Cao et al.

(10) Patent No.: US 12,507,805 B2
(45) Date of Patent: Dec. 30, 2025

(54) MULTIFUNCTIONAL IRON FRAME AND SEAT

(71) Applicant: JASON FURNITURE (HANGZHOU) CO., LTD., Zhejiang (CN)

(72) Inventors: Jizhong Cao, Zhejiang (CN); Yuanfeng Feng, Zhejiang (CN); Jundong Gao, Zhejiang (CN); Qingke Kong, Zhejiang (CN); Yun Su, Zhejiang (CN)

(73) Assignee: JASON FURNITURE (HANGZHOU) CO., LTD., Zhejiang (CN)

( * ) Notice: Subject to any disclaimer, the term of this patent is extended or adjusted under 35 U.S.C. 154(b) by 198 days.

(21) Appl. No.: 18/522,721

(22) Filed: Nov. 29, 2023

(65) Prior Publication Data

US 2025/0017382 A1 Jan. 16, 2025

(30) Foreign Application Priority Data

Jul. 14, 2023 (CN) ..... 202310873309.0
Jul. 20, 2023 (CN) ..... 202310891452.2

(51) Int. Cl.
*A47C 7/50* (2006.01)
*A47C 7/00* (2006.01)

(52) U.S. Cl.
CPC ..... *A47C 7/5068* (2018.08); *A47C 7/5062* (2018.08); *A47C 7/004* (2013.01); *A47C 7/506* (2013.01)

(58) Field of Classification Search
CPC ..... A47C 7/50; A47C 7/506; A47C 7/5062; A47C 7/5068
See application file for complete search history.

(56) References Cited

U.S. PATENT DOCUMENTS 10,631,652 B2 * 4/2020 Mackert ..... A47C 7/5062
11,930,937 B2 * 3/2024 Mackert ..... A47C 1/0345
(Continued)

FOREIGN PATENT DOCUMENTS

CN 207477253 U * 6/2018
CN 108556695 A 9/2018
(Continued)

OTHER PUBLICATIONS

First Office Action received in corresponding Chinese patent application No. 202310891452.2, dated Apr. 30, 2025, 24 pages.

*Primary Examiner* — Rodney B White
(74) *Attorney, Agent, or Firm* — Cooper Legal Group, LLC

(57) ABSTRACT

The present application discloses a multifunctional iron frame and seat, including a driving mechanism, a leg support mechanism, and a linkage mechanism. The leg support mechanism includes a leg support skeleton and a support plate. The linkage mechanism is connected between the driving mechanism and the leg support skeleton. When the multifunctional iron frame is rotated from a sitting state to a first position, the leg support skeleton rotates relative to the seat frame, and a rotation radius of the support plate at the first position is not greater than in the sitting state. When the multifunctional iron frame is rotated from the first position to a lying state, the leg support skeleton rotates relative to the seat frame and the support plate slides relative to the leg support skeleton. The rotation radius of the support plate in the first position is smaller than that in the lying state.

9 Claims, 16 Drawing Sheets

(56) References Cited

U.S. PATENT DOCUMENTS

| | | | | |
|---|---|---|---|---|
| 11,963,616 | B2 * | 4/2024 | Mackert | A47C 1/0352 |
| 12,022,951 | B2 * | 7/2024 | Lu | A47C 1/037 |
| 2021/0353064 | A1 | 11/2021 | Chen et al. | |

FOREIGN PATENT DOCUMENTS

| | | | | | |
|---|---|---|---|---|---|
| CN | 108784948 | A | | 11/2018 | |
| CN | 208941402 | U | | 6/2019 | |
| CN | 109984504 | A | * | 7/2019 | A47C 7/506 |
| CN | 112716192 | A | | 4/2021 | |
| CN | 214230619 | U | | 9/2021 | |
| CN | 218571814 | U | | 3/2023 | |
| CN | 220256070 | U | | 12/2023 | |
| DE | 29909441 | U1 | | 8/1999 | |
| DE | 202006009470 | U1 | | 8/2006 | |
| DE | 102006019871 | A1 | | 10/2007 | |
| DE | 202007004695 | U1 | * | 8/2008 | A47C 1/0347 |
| DE | 202013002907 | U1 | | 4/2013 | |
| DE | 102012204670 | A1 | | 9/2013 | |
| DE | 102013208562 | A1 | | 11/2014 | |
| DE | 102015106922 | A1 | * | 11/2016 | A47C 7/5062 |
| DE | 202019104069 | U1 | | 8/2019 | |
| DE | 102018204987 | A1 | | 10/2019 | |
| EP | 2356922 | A1 | | 8/2011 | |
| EP | 2687130 | A1 | | 1/2014 | |
| JP | 2008049852 | A | | 3/2008 | |
| WO | 2022000968 | A1 | | 1/2022 | |
| WO | 2023124193 | A1 | | 7/2023 | |

* cited by examiner

MULTIFUNCTIONAL IRON FRAME AND SEAT

CROSS-REFERENCE TO RELATED APPLICATION

The present application claims the priority and benefit of Chinese patent application serial no. 202310891452.2, filed on Jul. 20, 2023, and Chinese patent application serial no. 202310873309.0, filed on Jul. 14, 2023. The entireties of Chinese patent application serial no. 202310891452.2 and Chinese patent application serial no. 202310873309.0 are hereby incorporated by reference herein and made a part of this specification.

TECHNICAL FIELD

The present application relates to the field of home furnishings, and, in particular, to a multifunctional iron frame and a seat.

BACKGROUND

With the development of the home furnishings industry, people are increasingly demanding the functionality of seats. At present, an existing leg support adjustment mechanism is composed of a motor push rod or other connected multi-level linkage mechanism to rotate and fold the leg support plate upward from under the seat. The leg support mechanism rotates and drives the support plate to extend, thereby achieving a joint function of leg support rotation and extension.

Due to the fact that the extension of the leg support plate changes synchronously with the rotation of the leg support under the push of a multi-level linkage mechanism, in general, when the leg support mechanism is rotated and unfolded, the leg support plate is further rotated and extended synchronously. Due to a pivot connection between the leg support plate and the linkage mechanism, the elongation of the leg support plate varies proportionally with a rotation angle. Therefore, a larger space has to be left below the seat so that the leg support does not interfere with the ground during rotation, which takes up a larger space and increase the height of the seat, affecting the comfort of the seat.

SUMMARY OF THE INVENTION

In order to solve the above technical problems, the present application provides a multifunctional iron frame and seat, which has a simple structure, small occupancy space, and high reliability, improving the comfort experience of a user.

In a first aspect, the present application provides a multifunctional iron frame, including a seat frame, and further includes:

a driving mechanism, connected to the seat frame;

a leg support mechanism, including a leg support skeleton and a support plate sliding relative to the leg support skeleton, wherein the leg support skeleton is rotatably connected to the seat frame; and a linkage mechanism, connected between the driving mechanism and the leg support skeleton and pivotally connected to the seat frame, wherein the driving mechanism drives the leg support skeleton to rotate relative to the seat frame via the linkage mechanism;

wherein, when the multifunctional iron frame is rotated from a sitting state to a first position, the leg support skeleton is rotated relative to the seat frame, wherein a rotation radius of an end of the support plate at the first position is not greater than the rotation radius of the end at the sitting state; and, when the multifunctional iron frame is rotated from the first position to a lying state, the leg support skeleton is rotated relative to the seat frame and the support plate is slid relative to the leg support skeleton, wherein a rotation radius of the end of the support plate at the first position is less than the rotation radius of the end in the lying state.

By adopting the above technical solution, the connection structure of a conventional leg support mechanisms that can only rotate relative to a support structure is changed. The rotation radius of the support plate at different rotation positions can be controlled by synchronously rotating the support plate and leg support skeleton, and sliding relative to the leg support skeleton. Before the support plate rotates and flips out from under the seat frame, the support plate does not slide relative to the leg support skeleton, reducing the rotation radius of the support plate under the seat frame, which can reduce the probability of interference between the support plate and the ground. The structure is simple, occupies little space, and can reduce the height of the seat when applied, meeting the user's comfort experience. The driving mechanism is connected to the seat frame, and can be manually driven to achieve the rotation and extension of the support plate. It can further be driven by electric or pneumatic means, with a flexible and reliable driving structure.

In combination with the first aspect, a further technical solution includes a backrest mechanism, wherein the backrest mechanism comprises a backrest frame pivotally connected to the seat frame, the backrest mechanism is connected to the driving mechanism, the driving mechanism is configured to drive the backrest frame to rotate relative to the seat frame, and the linkage mechanism is connected between the backrest mechanism and the leg support skeleton, so as to enable the backrest frame and the leg support skeleton to rotate synchronously relative to the seat frame.

By adopting the above technical solution, the backrest mechanism and leg support mechanism can achieve linkage. When switching between a sitting state and a lying state, the backrest frame and leg support skeleton can be synchronously rotated, reducing the difficulty of adjustment and making the switching faster and more convenient.

In combination with the first aspect, a further technical solution includes a base and a seat frame adjusting mechanism, wherein the seat frame adjusting mechanism comprises a first rotating rod and a second rotating rod, two ends of the first rotating rod are pivotally connected to the driving mechanism and the base, respectively, and two ends of the second rotating rod are pivotally connected to the base and the seat frame, respectively, so that the base, the first rotating rod, the seat frame and the second rotating rod are sequentially connected to form a planar four-bar linkage mechanism.

By adopting the above technical solution, a single driving source can be used to simultaneously control angle adjustment of the seat frame, angle adjustment of the backrest, angle adjustment of the leg support, and extension and retraction of the leg support, achieving zero gravity and flat lying state of the seat.

In combination with the first aspect, a further technical solution is provided, wherein a driving end of the driving mechanism is provided with a gear, the backrest mechanism further comprises a toothed plate engaged with the gear and a backrest connecting rod hinged with the toothed plate, the backrest frame is hinged with the backrest connecting rod, and the toothed plate is pivotally connected to the seat frame, so that the toothed plate, the backrest connecting rod and the backrest frame are sequentially connected to form a four-bar linkage mechanism.

By adopting the above technical solution, the driving mechanism rotates via a four-bar linkage mechanism formed by connecting the toothed plate, backrest link, and backrest frame to achieve the angle change of the backrest frame relative to the seat frame, thereby adjusting the inclination of the seat backrest. The structure is simple and reliable. The driving mechanism is meshed with the gears and the toothed plate, and the connection structure is simple and reliable, which can increase the driving force.

In combination with the first aspect, a further technical solution is provided, wherein the leg support mechanism further comprises a first leg support connecting rod fixedly connected to the leg support skeleton and a second leg support connecting rod hinged to the first leg support connecting rod, and the second leg support connecting rod is hinged to the linkage mechanism.

By adopting the above technical scheme, the driving mechanism drives the second leg support connecting rod and the first leg support connecting rod to rotate via a linkage mechanism, thereby driving the leg support skeleton to rotate relative to the seat frame. By adjusting a length of the first leg support connecting rod and the second leg support connecting rod, different rotation speeds of the leg support skeleton in different positions can be achieved. In this way, it can be achieved that the speed of the leg support skeleton is fast when it rotates under the seat frame, and the rotation speed of the leg support skeleton is relatively slow when it rotates from below the seat frame and the leg support slides relative to the leg support skeleton. This can improve the switching efficiency of the leg support mechanism, and further improve the comfort of the leg support mechanism when it rotates from below the seat frame and supports the legs of the user.

In combination with the first aspect, a further technical solution is provided, wherein the linkage mechanism includes a connecting rod and a rotating rod, the rotating rod is pivotally connected to the seat frame, a middle portion of the connecting rod is hinged with the rotating rod, and two ends of the connecting rod are rotatably connected to the second leg support connecting rod and the backrest mechanism, respectively.

By adopting the above technical solution, the rotating rod restricts the motion trajectory of the middle portion of the connecting rod, and the second leg support connecting rod and backrest mechanism connected at both ends of the connecting rod further rotate relative to the rotating rod while moving with the motion of the rotating rod, thus achieving a rotation linkage between the backrest mechanism and leg support mechanism. At the same time, the rotation angle of the backrest frame relative to the seat frame can be adapted to the rotation angle of the leg support skeleton relative to the seat frame, so as to meet the comfort experience of users in different positions and states of the multifunctional iron frame.

In combination with the first aspect, a further technical solution is provided, wherein the leg support mechanism further includes an eccentric connecting rod and a connecting rod assembly, a first end of the eccentric connecting rod is hinged with the seat frame, a second end of the eccentric connecting rod is connected to the connecting rod assembly and slidingly connected with the leg support skeleton, and the connecting rod assembly is hinged with the support plate.

By adopting the above technical solution, the eccentric connecting rod and connecting rod assembly can achieve the sliding of the support plate relative to the leg support skeleton during the rotation process of the leg support skeleton, achieving sufficient support for the legs of the user in a lying state, and improving the comfort of the user in the lying state.

In combination with the first aspect, a further technical solution is provided, wherein the connecting rod assembly includes a slider rotatably connected to the eccentric connecting rod, a first connecting rod connected to the slider, and a second connecting rod hinged with the first connecting rod, the second connecting rod is hinged with the support plate, and the first connecting rod is pivotally connected to the leg support skeleton.

By adopting the above technical scheme, the eccentric connecting rod drives the slider to slide relative to the leg support skeleton. When the slider slides, it drives the first connecting rod to rotate relative to the leg support skeleton. The first connecting rod rotates and drives the second connecting rod to rotate, thereby achieving the sliding of the support plate relative to the leg support skeleton. This enables different linkage modes for the rotation and sliding of the support plate at different positions. By adjusting the position of the pivot connecting shaft between the first connecting rod and the leg support skeleton, and changing a force arm ratio of the connection points at both ends of the first connecting rod, the speed adjustment of the support plate at different positions can be achieved.

In combination with the first aspect, a further technical solution is provided, wherein the first connecting rod is provided with a connecting rod sliding groove, a first end of the sliding rod is rotatably connected to the eccentric connecting rod, and a second end of the sliding rod is configured to slide along the connecting rod sliding groove. During the rotation of the leg support skeleton relative to the seat frame, the eccentric connecting rod drives the sliding rod to slide relative to the leg support skeleton. During the sliding process of the slider, the connecting rod assembly can be pushed to rotate to cause the support plate to slide relative to the leg support skeleton.

By adopting the above technical solution, the first connecting rod is provided with a connecting rod sliding groove, which allows the slider to slide along the connecting rod sliding groove while sliding relative to the leg support skeleton. This allows for different rotational speeds of the first connecting rod when the support plate rotates at different positions, and further controls the sliding speed of the support plate relative to the leg support skeleton at different positions. For example, when the support plate rotates under the seat frame, the slider slides relative to the connecting rod sliding groove, which can achieve no rotation or slow rotation of the first connecting rod, reducing the space occupied by the support plate during the rotation process. When the support plate is overturned from under the seat frame, the slider is located at a extreme position of the connecting rod slide, which can drive the first connecting rod to rotate quickly, that is, a rapid sliding of the support plate from the leg support skeleton, improving switching efficiency.

In a second aspect, the present application provides a seat, including a multifunctional iron frame as described in the first aspect.

By adopting the above technical solution, a seat with a multifunctional iron frame in the first aspect can achieve that during the rotation of the leg support skeleton from the sitting posture to the first position, the support plate maintains relative motion to the leg support skeleton within a certain angle range of rotation of the leg support skeleton. When the leg support skeleton rotates beyond a certain angle, the support plate extends and slides relative to the leg support skeleton. This can achieve non sliding and elongation of the support plate when it is under the seat frame, and sliding and elongation relative to the leg support skeleton after the support plate rotates from below the seat frame. This can not only reduce the height of the lower space of the seat, but further achieve comfort in leg support. The compact structure and relatively small appearance size of the seat can meet more comfort needs of users, truly putting users at the center and enhancing their experience.

In summary, the present application can achieve at least one of the following beneficial technical effect.

1. The present application features a multifunctional iron frame with a simple product structure and occupies less space during various position switching processes.

2. The multifunctional iron frame of the present application changes a connection structure where the traditional support plate can only rotate relative to the seat frame. By sliding relative to the leg support skeleton, the rotation radius of the support plate at different rotation positions is controlled, with small rotation space. Different rotation positions have different movements to achieve different functions, and the application range is wider.

3. The seat in the present application can reduce the height of the seat, facilitate the switching between sitting and lying states, allowing multiple sitting states, which can meet more comfortable demands of a user.

DETAILED DESCRIPTION

Figure 1:
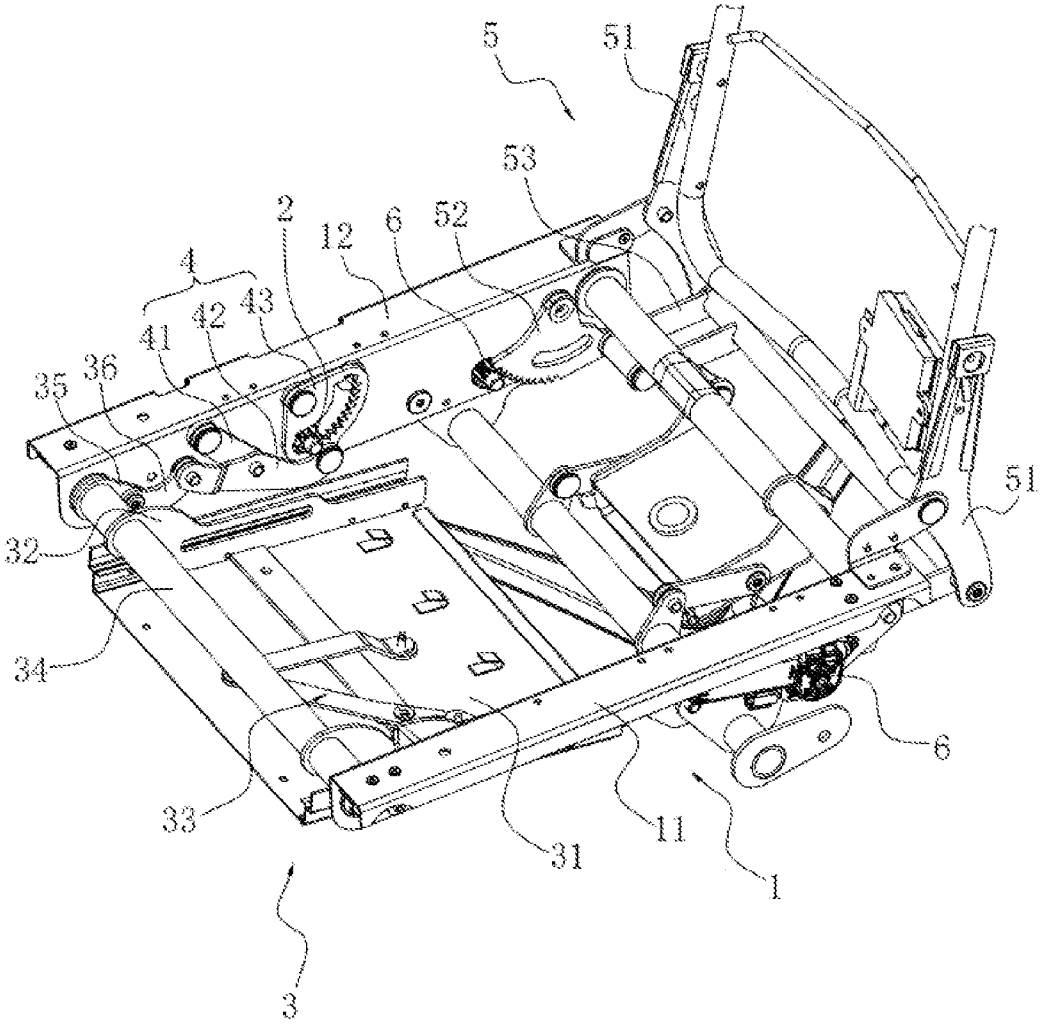
FIG. 1 is a schematic structural diagram of a first embodiment of a multifunctional iron frame of the present application.

For a better understanding of the purpose, technical solutions, and advantages of embodiments of the present application, the present application will be further described below in details in conjunction with the drawings. The assemblies of the embodiments of the present application typically described and shown in the drawings can be arranged and designed in various different configurations. Based on the embodiments in the present application, all other embodiments obtained by ordinary technicians in the art without creative labor fall within the scope of protection of the present application.

It should be noted that similar labels and letters represent similar terms in the drawings, and, once an item is defined in a figure, further definition and explanation are not required in subsequent figures.

In the description of the present application, it should be noted that, unless otherwise specified and limited, the terms "installation", "in connection with", and "connection" should be understood broadly, for example, they can be fixed connection, detachable connection, or integrated connection; or, alternatively, it can be a mechanical connection or an electrical connection; or, alternatively, it can be directly connected, or indirectly connected via an intermediate medium, or it can be internal communication between two components. For those skilled in the art, the specific meanings of the above terms in the present application can be understood in particular circumstances.

In the description of the present application, it should be understood that, the terms "up", "down", "left", "right", etc. indicate the orientation or positional relationship based on the orientation or positional relationship shown in the drawings, only for the convenience of describing the present application and simplifying the description, rather than indicating or implying that a device or component referred to must have a specific orientation, or be constructed and operated in a specific orientation, and therefore should not be understood as a limitation to the present application.

The following will provide a detailed explanation of some embodiments of the present application in conjunction with the drawings. Without conflict, the features in the following embodiments can be combined with each other.

Embodiment 1

Referring to FIG. 1, a structural diagram of an embodiment of a multifunctional iron frame is illustrated. The multifunctional iron frame includes a left seat frame 11, a right seat frame 12, a leg support mechanism 3, a linkage mechanism 4, and a driving mechanism 2 that drives the leg support mechanism 3 to rotate via the linkage mechanism 4. The multifunctional iron frame further includes a backrest mechanism 5, which includes a backrest drive shaft 6 as a power source. The backrest drive shaft 6 is fixedly connected to a motor shaft of a drive motor and pivotally connected to a gear on the seat frame 1. The backrest drive shaft 6 can further be manually driven to rotate to achieve the movement of the backrest mechanism 5. The backrest mechanism 5 further includes a backrest frame 51 pivotally connected to the seat frame 1, a toothed plate engaged with the backrest drive shaft 6, and a backrest connecting rod 53 hinged with the toothed plate. The backrest frame 51 is hinged with the backrest connecting rod 53 at one end departing from the toothed plate, and the toothed plate is pivotally connected to the seat frame 1. The toothed plate, the backrest connecting rod 53, and the backrest frame 51 are sequentially connected to form a four-bar linkage mechanism.

The driving mechanism 2 is fixedly connected to the seat frame 1, and the driving mechanism 2 includes a gear rotatably connected to the seat frame 1. The gear can be fixedly connected to a motor shaft of a motor or manually driven to rotate. The leg support mechanism 3 includes a leg support skeleton 32 and a support plate 31 that slides relative to the leg support skeleton 32. The leg support skeleton 32 is rotatably connected to the seat frame 1 via a rotating shaft 34, which is pivotally connected to the seat frame 1, and the leg support skeleton 32 is fixedly connected to the rotating shaft 34. The rotating shaft 34 is further fixedly connected with a first leg support connecting rod 35 and a second leg support connecting rod 36 rotatably connected to the first leg support connecting rod 35. A connecting rod assembly 33 is further rotatably connected between the leg support skeleton 32 and the support plate 31, and the rotation of the connecting rod assembly 33 can drive the support plate 31 to slide relative to the leg support skeleton 32. The linkage mechanism 4 includes a rotating rod 41, a connecting rod 42, and a front toothed plate 43. The rotating rod 41 is pivotally connected to the seat frame 1, and a middle portion of the connecting rod 42 is hinged with a connecting end of the rotating rod 41 departing from the seat frame 1. Two ends of the connecting rod 42 are respectively rotatably connected to the second leg support connecting rod 36 and the front toothed plate 43. The driving mechanism 2 drives the leg support skeleton 32 to rotate relative to the seat frame 1 via the linkage mechanism 4.

The multifunctional iron frame has two use states: sitting state and lying state, as well as a first position between the sitting and lying states. This first position is a position where the support plate 31 is closest to the ground when being overturned outward from below the seat frame 1. When the multifunctional iron frame rotates from the sitting state to the first position, the leg support skeleton 32 rotates relative to the seat frame 1, in which a rotation radius of an end of the support plate 31 in the first position is not greater than its rotation radius in the sitting state. When the multifunctional iron frame rotates from the first position to the lying state, the leg support skeleton 32 rotates relative to the seat frame 1, and the support plate 31 can be configured to slide relative to the leg support skeleton 32 according to needs. The rotation radius of the end of the support plate 31 in the first position is smaller than its rotation radius in the lying state.

Figure 2:
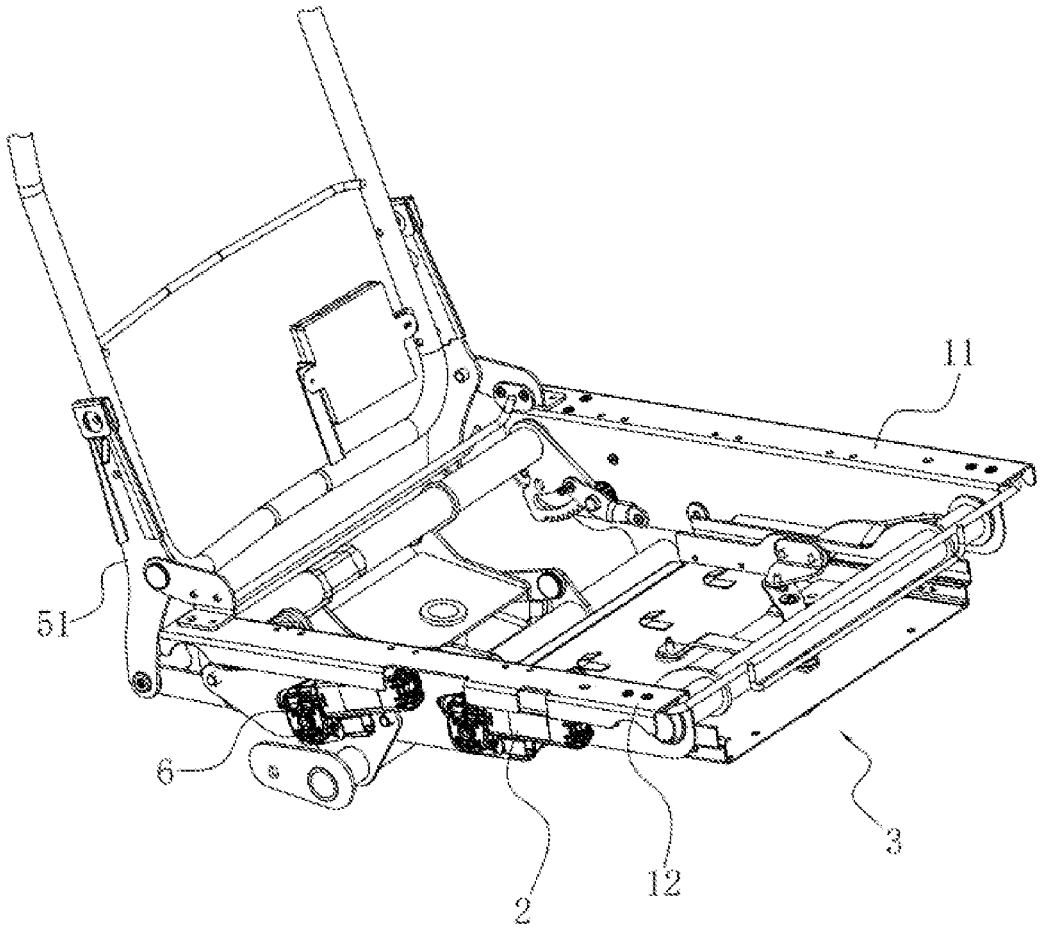
FIG. 2 is a schematic structural diagram of the first embodiment of the multifunctional iron frame of the present application viewed from another perspective.

Referring to FIG. 2, the backrest mechanism 5 and leg support mechanism 3 are respectively driven by two motors fixed on the right seat frame 12. The backrest mechanism 5 uses a motor fixedly connected to the backrest drive shaft 6 as the power source to drive the rotation of the backrest frame 51 relative to the left seat frame 11 and the right seat frame 12. The leg support mechanism 3 uses a drive mechanism 2 fixed on the right seat frame 12 as the power source to rotate relative to the left seat frame 11 and the right seat frame 12. The drive mechanism 2 can also be an electric motor. In this embodiment, the power sources of backrest mechanism 5 and leg support mechanism 3 are both electric motors, which can be directly driven or driven via a gear mechanism. In practical use, the power source can also use other driving methods, such as pneumatic, hydraulic, or mechanical lever manual driving.

Figure 3:
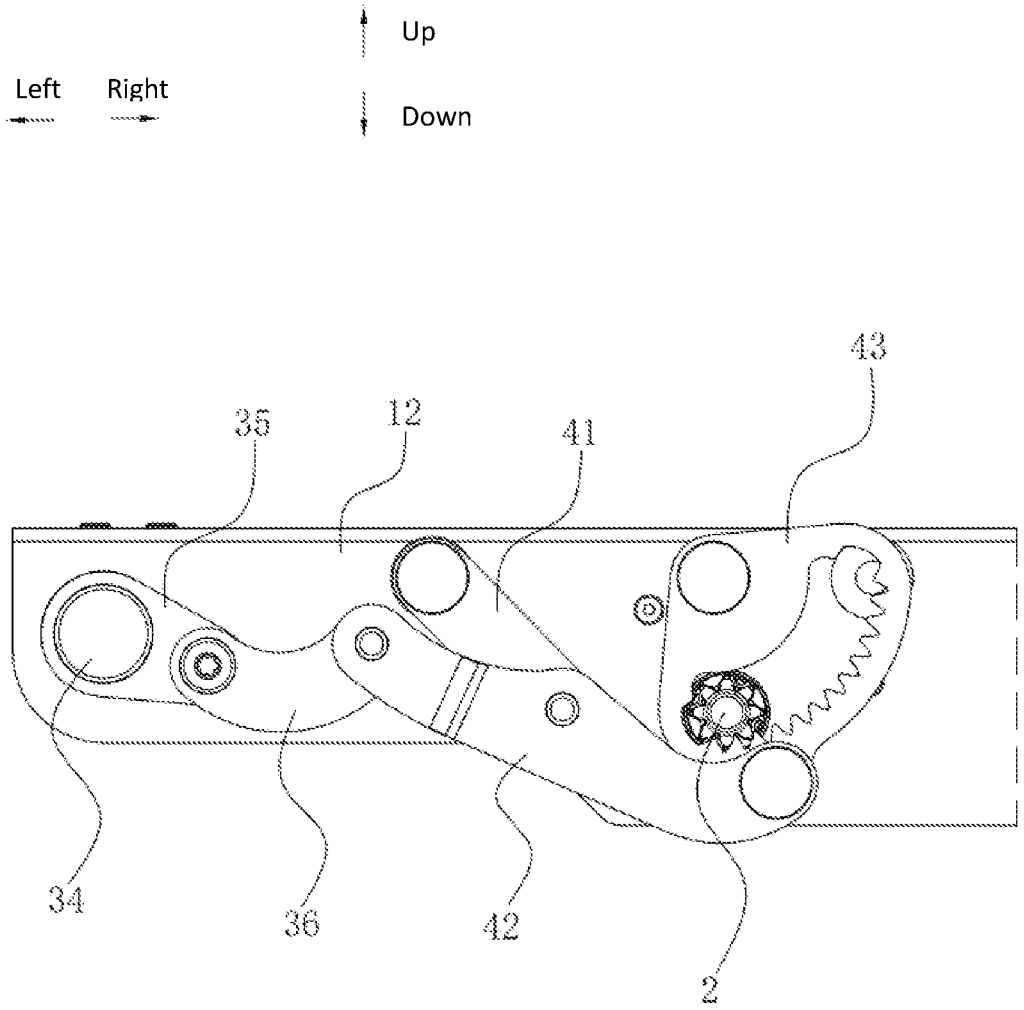
FIG. 3 is a schematic structural diagram of a linkage mechanism of the first embodiment of the multifunctional iron frame of the present application in a sitting state.

Referring to FIG. 3, a structural diagram of a linkage mechanism 4 of a multifunctional iron frame in a sitting state is provided. The front toothed plate 43 is provided with internal teeth, and the gear driven by the driving mechanism 2 is meshed with the internal teeth of the front toothed plate 43. According to design requirements, the front toothed plate 43 can also be configured to engage with external teeth and gears. When the multifunctional iron frame is in a sitting state, the gear of the driving mechanism 2 is located at a left end of the inner teeth of the front toothed plate 43, the connecting end of the rotating rod 41 and the connecting rod 42 is tilted to the right, the connecting end of the connecting rod 42 and the second leg support connecting rod 36 is tilted upwards, and the rotating shaft 34 is correspondingly rotated to position the connecting end of the first leg support connecting rod 35 and the second leg support connecting rod 36 between the rotating shaft 34 and the connecting rod 42.

Figure 4:
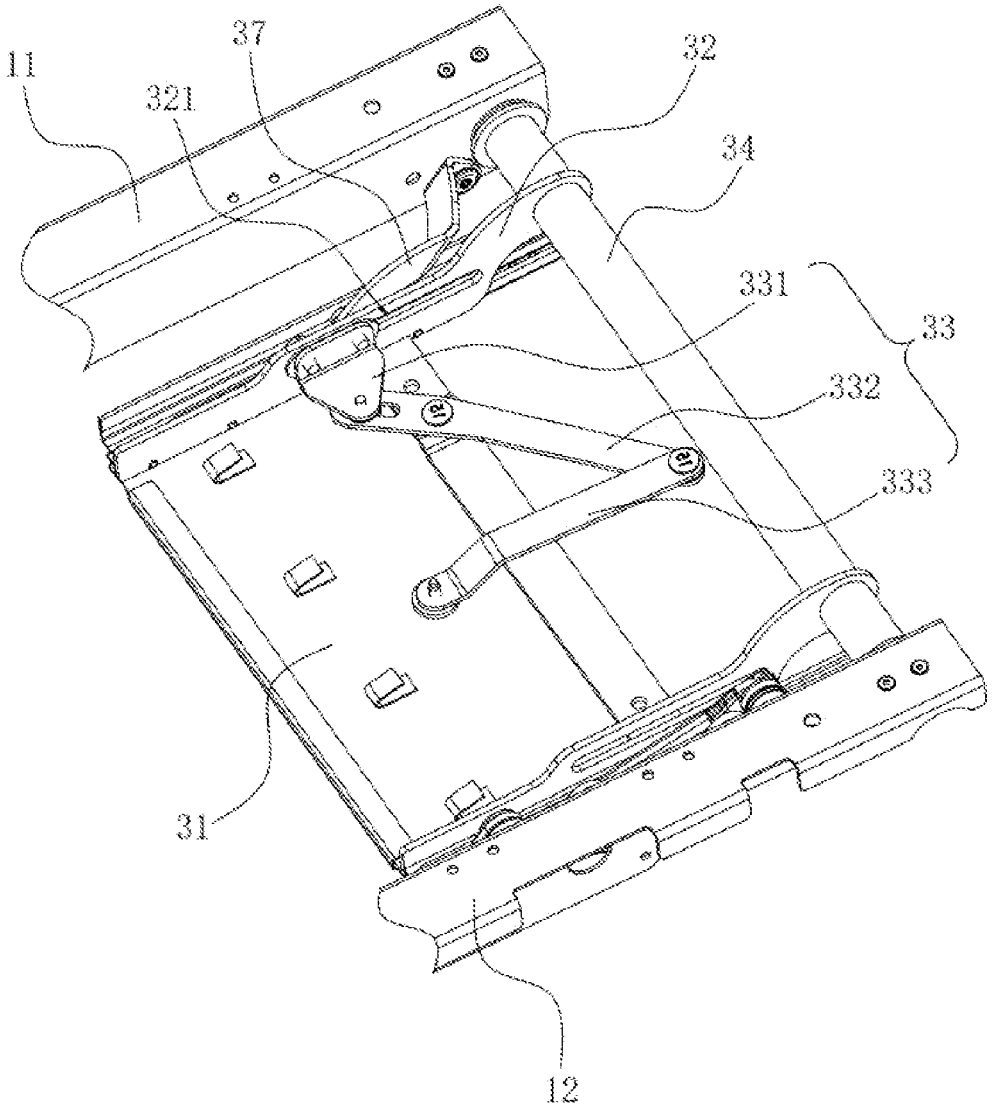
FIG. 4 is a schematic structural diagram of a connecting rod assembly of the first embodiment of the multifunctional iron frame of the present application in a sitting state.
Figure 5:
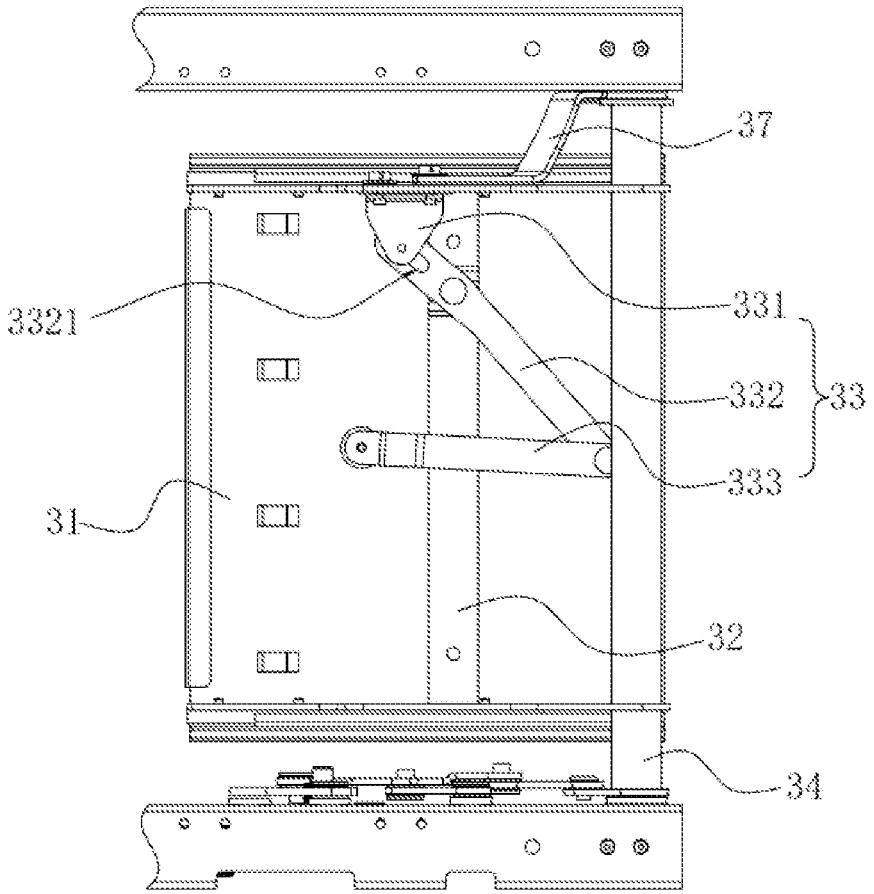
FIG. 5 is a top view of the connecting rod assembly of the first embodiment of the multifunctional iron frame of the present application in a sitting state.

Referring to FIGS. 4 and 5, structural diagrams of a connecting rod assembly 33 of a multifunctional iron frame in this embodiment in a sitting state are shown. The connecting rod assembly 33 includes a slider 331, a first connecting rod 332 connected to the slider 331, and a second connecting rod 333 hinged to one end of the first connecting rod 332 departing from the slider 331. The end of the second connecting rod 333 departing from the first connecting rod 332 is hinged to the support plate 31, and a middle portion of the first connecting rod 332 is pivotally connected to the leg support skeleton 32, with a connection point being close to the slider 331. On the left seat frame 11, an eccentric connecting rod 37 is further hinged, and an end of the eccentric connecting rod 37 departing from the left seat frame 11 is hinged with the slider 331. The leg support skeleton 32 is provided with a skeleton sliding groove 321, and the slider 331 is slidingly arranged in the skeleton sliding groove 321. The first connecting rod 332 is further provided with a connecting rod sliding groove 3321, and an end of the slider 331 departing from the eccentric connecting rod 37 is slidingly arranged in the connecting rod sliding groove 3321. When the rotating shaft 34 rotates, the eccentric connecting rod 37 is driven to rotate and drive the slider 331 to slide along the skeleton sliding groove 321. During the sliding of the slider 331 along the skeleton sliding groove 321, it will slide or rotate relative to the first connecting rod 332. A centerline of the connecting rod sliding groove 3321 in this embodiment is a straight line, or it can be designed as a multi curve composed of multiple straight lines and curves according to design needs. The multi curve form can be applied to different motion states of the support plate 31 relative to the leg support skeleton 32 during the rotation of the shaft 34: sliding to the left, sliding to the right, or relatively stationary.

Figure 6:
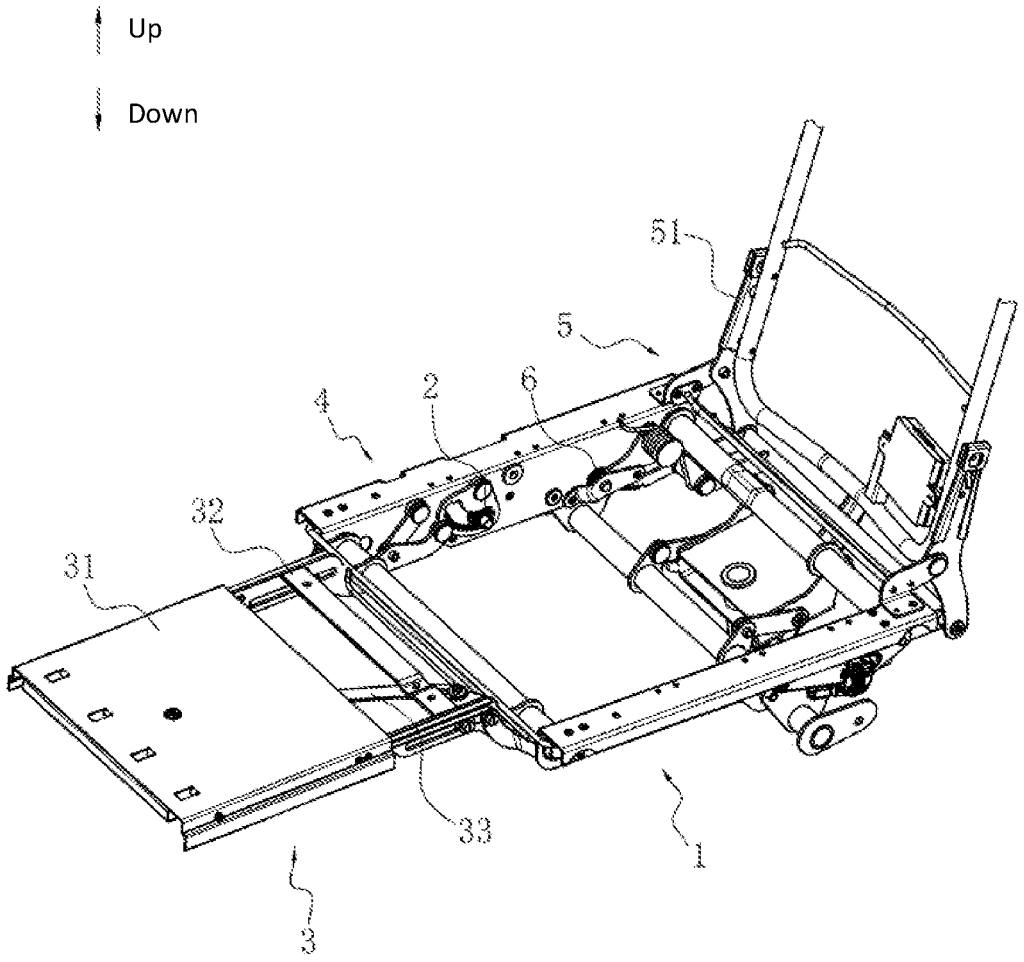
FIG. 6 is a schematic structural diagram of the first embodiment of the multifunctional iron frame of the present application in a lying state.

Referring to FIG. 6, a structural diagram of a multifunctional iron frame in this embodiment in a lying state is shown. In the lying state, the driving mechanism 2 pushes the leg support mechanism 3 via the linkage mechanism 4 to rotate and overturn upwards and outwards from below the seat frame 1, and the support plate 31 slides away from the seat frame 1 relative to the leg support skeleton 32 under the driving force of the connecting rod assembly 33. Under the drive of the backrest drive shaft 6, the backrest mechanism 5 can adjust the tilt angle of backrest frame 51 relative to seat frame 1 according to the needs of a user. The leg support mechanism 3 and the backrest mechanism 5 each have two power sources for driving, making the adjustment of the sitting posture more flexible and variable.

Figure 7:
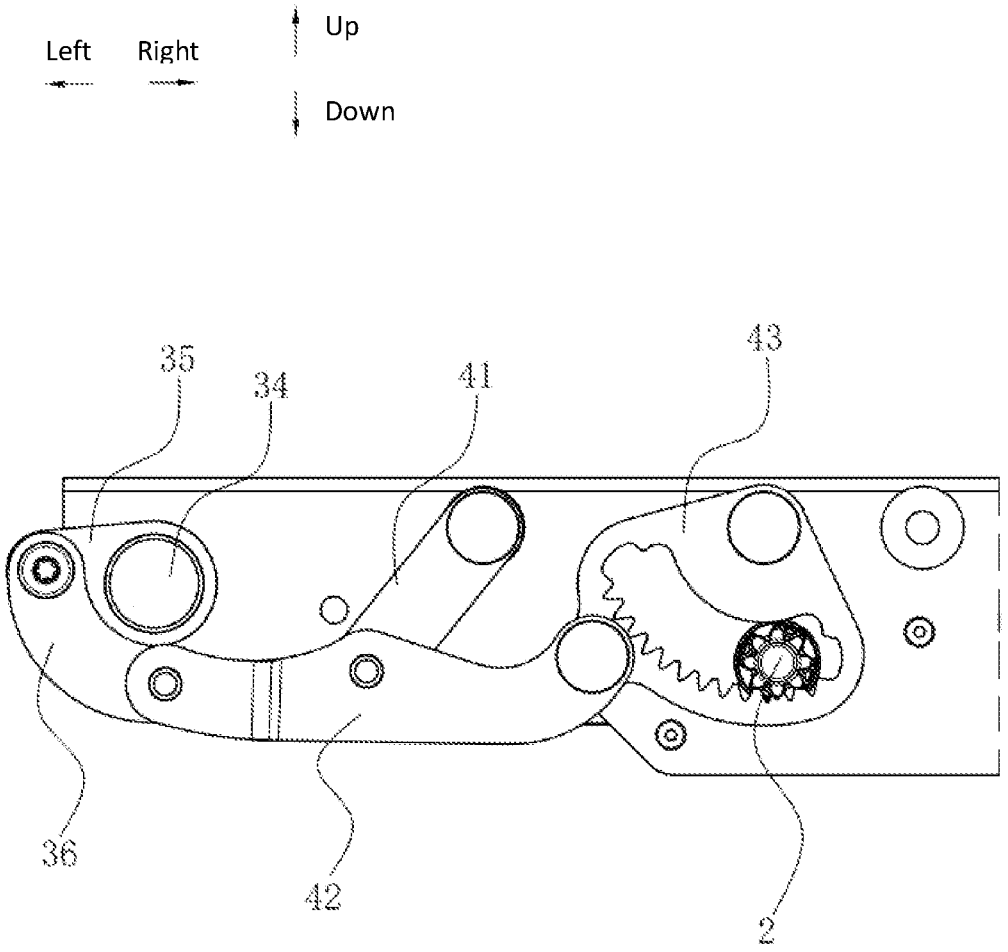
FIG. 7 is a schematic structural diagram of a linkage mechanism of the first embodiment of the multifunctional iron frame of the present application in a lying state.

Referring to FIGS. 6 and 7, structural diagrams of a linkage mechanism 4 of a multifunctional iron frame in this embodiment in a lying state are shown. The gear rotation of driving mechanism 2 causes the front toothed plate 43 meshed therewith to rotate clockwise in a direction shown in the figures. The front toothed plate 43 drives the connecting rod 42 to move left, and the connecting rod 42 pushes the second leg support connecting rod 36 to move left and causes the first leg support connecting rod 35 to rotate upwards due to the limitation of a rotation trajectory limit of the rotating rod 41. The first leg support connecting rod 35 drives the rotating shaft 34 to rotate clockwise. The rotation of the shaft 34 drives the leg support mechanism 3 to rotate synchronously, causing the leg support mechanism 3 to rotate and overturn from below the seat frame 1. In the lying state, an upper surface of the support plate 31 is approximately parallel or in a plane with an upper surface of the seat frame 1, in order to provide better support for the legs of the user. Of course, according to actual design and use requirements, the upper surface of the support plate 31 can further define an angle with the upper surface of the seat frame 1 in the lying state.

Figure 8:
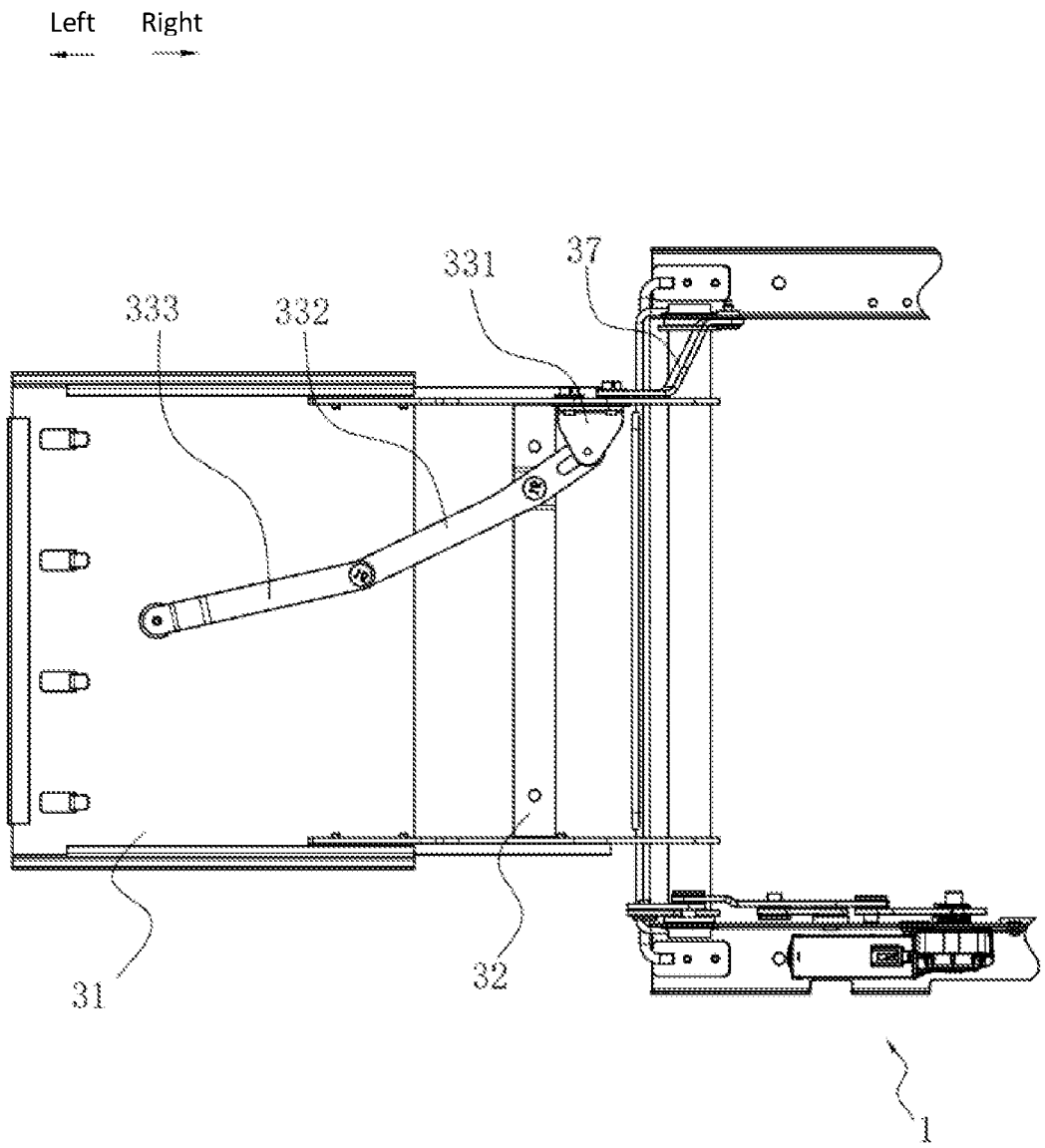
FIG. 8 is a schematic structural diagram of a connecting rod assembly of the first embodiment of the multifunctional iron frame of the present application in a lying state.

Referring to FIG. 8, a structural diagram of a connecting rod assembly 33 of a multifunctional iron frame in a lying state. Under the pulling of the eccentric connecting rod 37, the slider 331 slides to the left relative to the leg support skeleton 32. When the slider 331 slides, the first connecting rod 332 is pulled to rotate clockwise relative to the leg support skeleton 32 in a direction shown in the figure. During the rotation of the first connecting rod 332, the second connecting rod 333 is pushed to drive the support plate 31 to slide away from the seat frame 1 relative to the leg support skeleton 32. When the multifunctional iron frame returns from the lying state to the sitting state, reverse movements are involved, which will not be repeated here.

Embodiment 2

Referring to FIGS. 9 to 12, this embodiment differs from Embodiment 1 in that the backrest mechanism 5 and leg support mechanism 3 are driven by a same power source, namely the driving mechanism 2.

Figure 9:
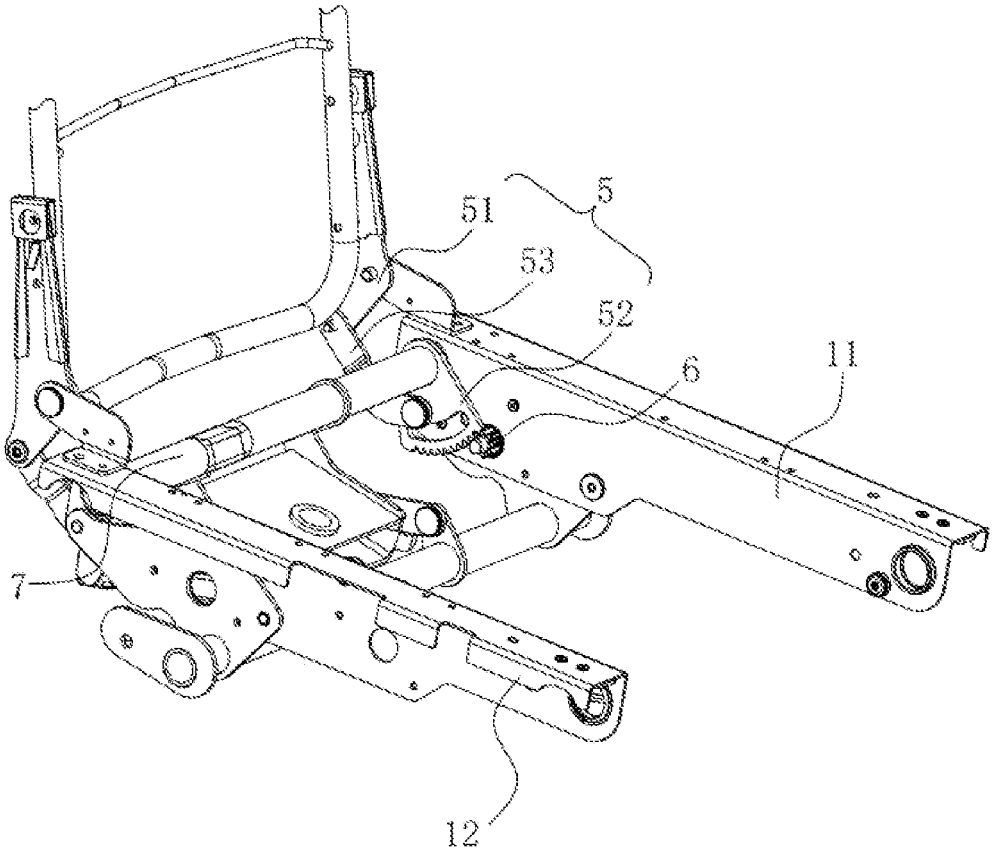
FIG. 9 is a schematic structural diagram of a second embodiment of a multifunctional iron frame of the present application.
Figure 10:
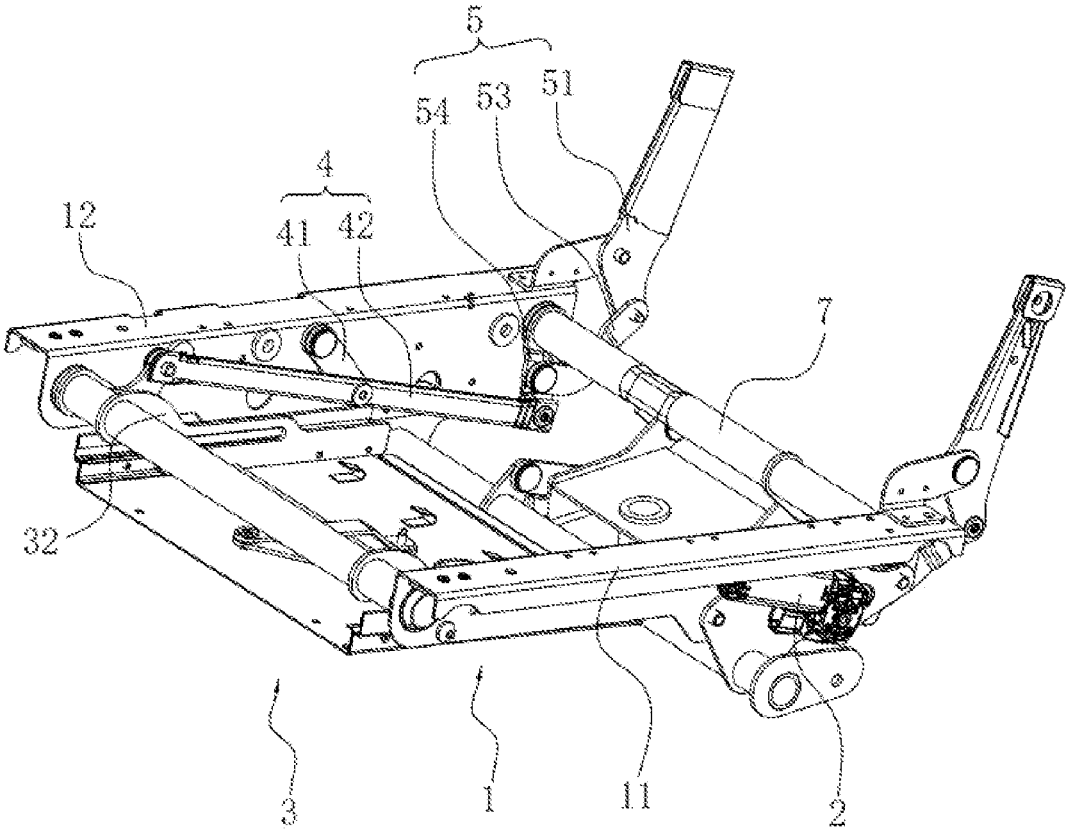
FIG. 10 is a schematic structural diagram of a second embodiment of the multifunctional iron frame of the present application viewed from another perspective.

Referring to FIGS. 9 and 10, in this embodiment, the linkage mechanism 4 is connected between the backrest mechanism 5 and the leg support skeleton 32 to synchronize the rotation of the backrest frame 51 and the leg support skeleton 32 relative to the seat frame 1. In order to provide more reasonable entire structure and space layout, improve the motion reliability of the multifunctional iron frame, and reduce the space occupied during operation, the linkage mechanism 4 and the driving mechanism 2 in this embodiment are respectively arranged on the right seat frame 12 and the left seat frame 11. The driving mechanism 2 synchronizes the motion of the backrest mechanism 5 and the linkage mechanism 4 via the transmission shaft 7.

The structure and principle of the driving mechanism 2 driving the transmission shaft 7 are the same as those in Embodiment 1. The toothed plate, backrest connecting rod 53, and the backrest frame 51 are sequentially connected to form a four-bar linkage mechanism, and the driving mechanism 2 drives the transmission shaft 7 to rotate. An end of the transmission shaft 7 near the right seat frame 12 is fixedly connected to the backrest rotating rod 54. An end of the backrest rotating rod 54 departing from the transmission shaft 7 is hinged with one end of the connecting rod 42, and the other end of the connecting rod 42 is hinged with the leg support mechanism 3. The connection structure and method are the same as those in Embodiment 1. A middle portion of the connecting rod 42 is hinged with the rotating rod 41, and an end of the rotating rod 41 departing from the connecting rod 42 is hinged with the right seat frame 12. In order to achieve synchronous rotation of the two backrest frames 51 pivotally connected to the left seat frame 11 and the right seat frame 12, the backrest connecting rod 53 is rotated between the backrest frame 51 and the backrest rotating rod 54 on the right seat frame 12. An end of the backrest connecting rod 53 departing from the backrest frame 51 is hinged to a middle portion of the backrest rotating rod 54. The backrest rotating rod 54, backrest connecting rod 53, and backrest frame 51 are sequentially connected to form a four-bar linkage mechanism with the same structure as that of the backrest mechanism 5 on the left seat frame 11.

Figure 11:
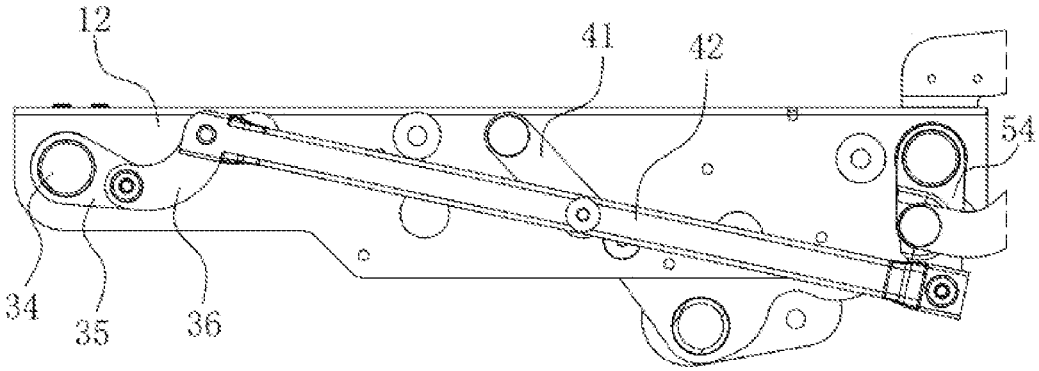
FIG. 11 is a schematic structural diagram of a linkage mechanism of the second embodiment of the multifunctional iron frame of the present application in a sitting state.

Referring to FIG. 11, a structural diagram of a linkage mechanism 4 of a multifunctional iron frame in this embodiment in a sitting state is shown. The backrest rotating rod 54 is approximately perpendicular to an upper surface of the right seat frame 12. An end of the rotating rod 41 connected to the connecting rod 42 is tilted to the right, and an end of the connecting rod 42 connected to the second leg support connecting rod 36 is tilted upwards. An end of the first leg support connecting rod 35 connected to the second leg support connecting rod 36 is located between the rotating shaft 34 and the connecting rod 42.

Figure 12:
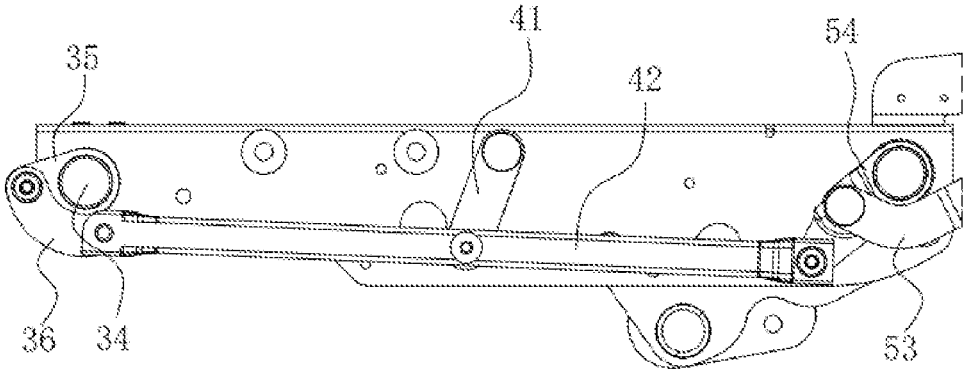
FIG. 12 is a schematic structural diagram of a linkage mechanism of the second embodiment of the multifunctional iron frame of the present application in a lying state.

Referring to FIG. 12, a structural diagram of a linkage mechanism 4 of a multifunctional iron frame in this embodiment in a lying state is shown. The backrest rotating rod 54 rotates clockwise in the direction shown in the figure. The backrest rotating rod 54 drives the connecting rod 42 to move left. The connecting rod 42, due to the limitation of the rotation trajectory of the rotating rod 41, pushes the second leg support connecting rod 36 to move left and causes the first leg support connecting rod 35 to rotate upwards. The first leg support connecting rod 35 drives the rotating shaft 34 to rotate clockwise. The rotation of the rotating shaft 34 drives the leg support mechanism 3 to rotate synchronously, so that the leg support mechanism 3 rotates and overturns from below the seat frame 1.

In this embodiment, the driving mechanism 2 synchronously drives the backrest frame 51 and the linkage mechanism 4 to rotate via a rear toothed plate 52 of the backrest mechanism 5 connected to the left seat frame 11 and a transmission shaft 7 fixedly connected to the rear toothed plate 52. The linkage mechanism 4, in turn, drives the leg support mechanism 3 to rotate synchronously, thereby achieving synchronous rotation of the backrest frame 51 and the support plate 31 via one driving mechanism 2. In addition, sliding relative to the leg support skeleton 32 can further be achieved during the rotation of the support plate 31, realizing simple and reliable structure and convenient adjustment.

Embodiment 3

Figure 13:
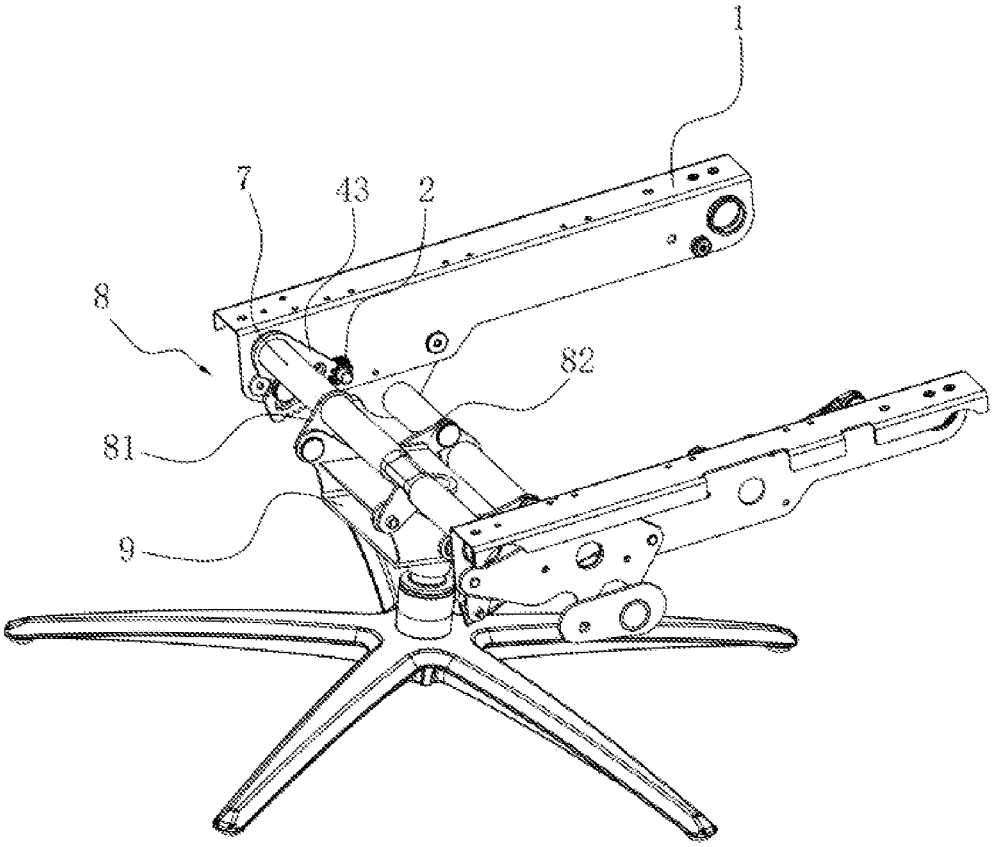
FIG. 13 is a schematic structural diagram of a third embodiment of a multifunctional iron frame of the present application.
Figure 14:
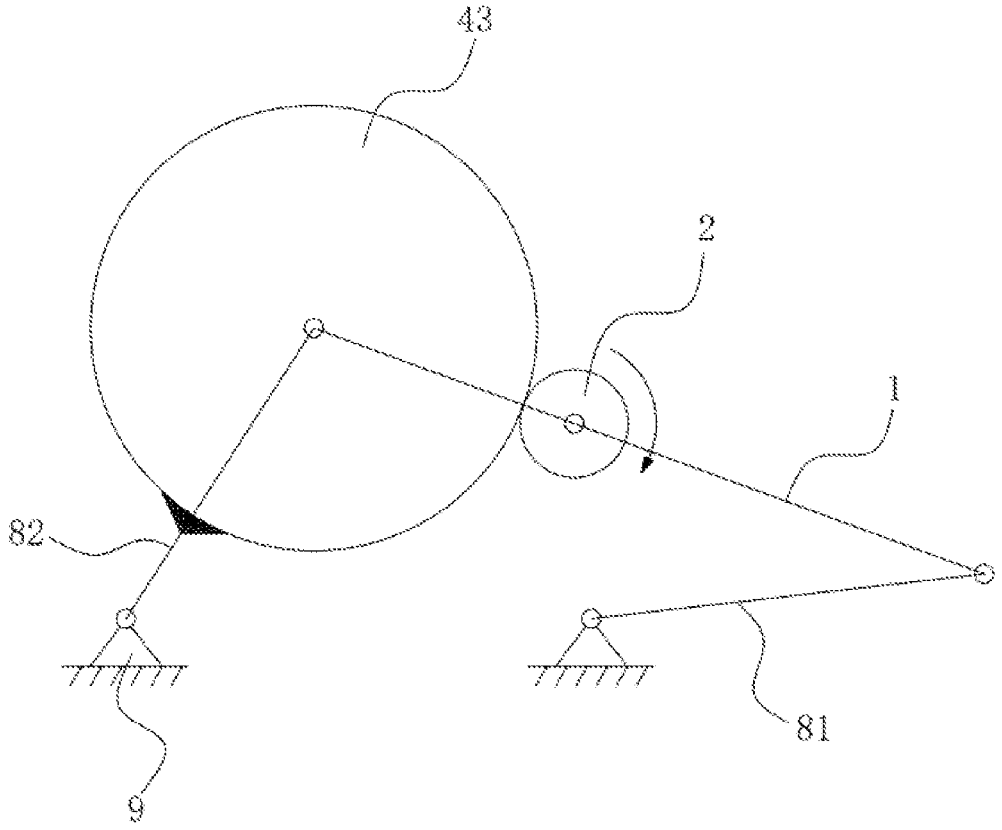
FIG. 14 is a schematic structural principle diagram of the third embodiment of the multifunctional iron frame of the present application.

Referring to FIGS. 13 and 14, unlike Embodiment 2, the multifunctional iron frame further includes a base 9, and a seat adjustment mechanism 8, which includes a first rotating rod 81 and a second rotating rod 82. One end of the first rotating rod 81 is pivotally connected to the base 9, and the other end of the first rotating rod 81 is fixedly connected to the front toothed plate 43 via the transmission shaft 7. The front toothed plate 43 meshes with the gear at an output end of the driving mechanism 2. Two ends of the second rotating rod 82 are pivotally connected to the base 9 and the seat frame 1, respectively. The base 9, the first rotating rod 81, the seat frame 1, and the second rotating rod 82 are sequentially connected to form a planar four-bar linkage mechanism. The front toothed plate 43 is driven by the driving mechanism 2 to rotate and drive the first rotating rod 81 to rotate around the base 9, thereby driving the relative rotation of the seat frame 1 to the base 9, achieving the angle adjustment of the seat frame 1 to the base 9.

This embodiment adopts a single driving source to simultaneously control angle adjustment of the seat frame, angle adjustment of the backrest, angle adjustment of the leg support, and extension and retraction of the leg support, achieving zero gravity and flat lying state of the seat.

On the other hand, this Embodiment can reserve sufficient seat activity space to increase comfort. The leg support mechanism 3 can be folded and placed under the seat frame 1, so that the leg support mechanism 3 and linkage mechanism 4 occupy less space, which is conducive to slimming design of the entire seat. It can be applied to other sofas and single chairs, making it easy to promote and apply.

Embodiment 4

Figure 15:
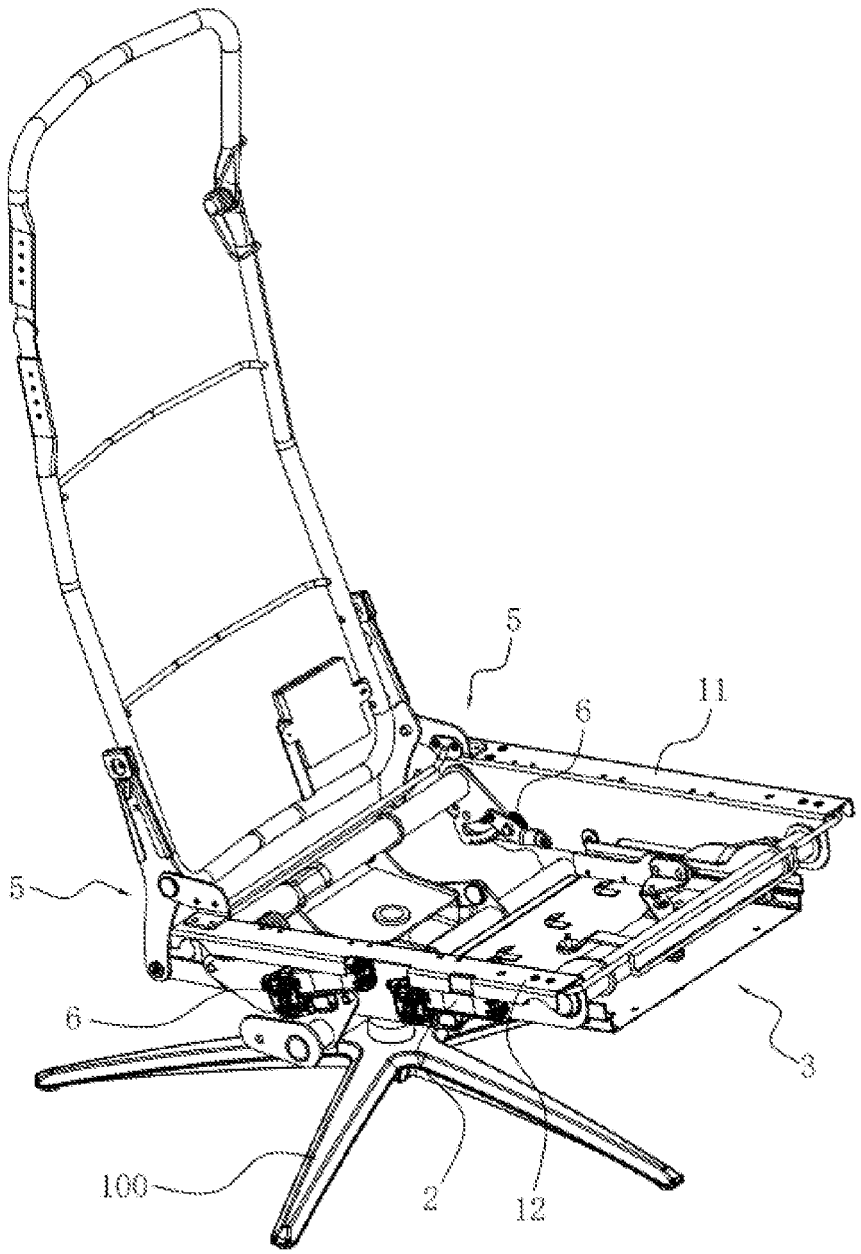
FIG. 15 is a schematic structural diagram of a fourth embodiment of the multifunctional iron frame of the present application.
Figure 16:
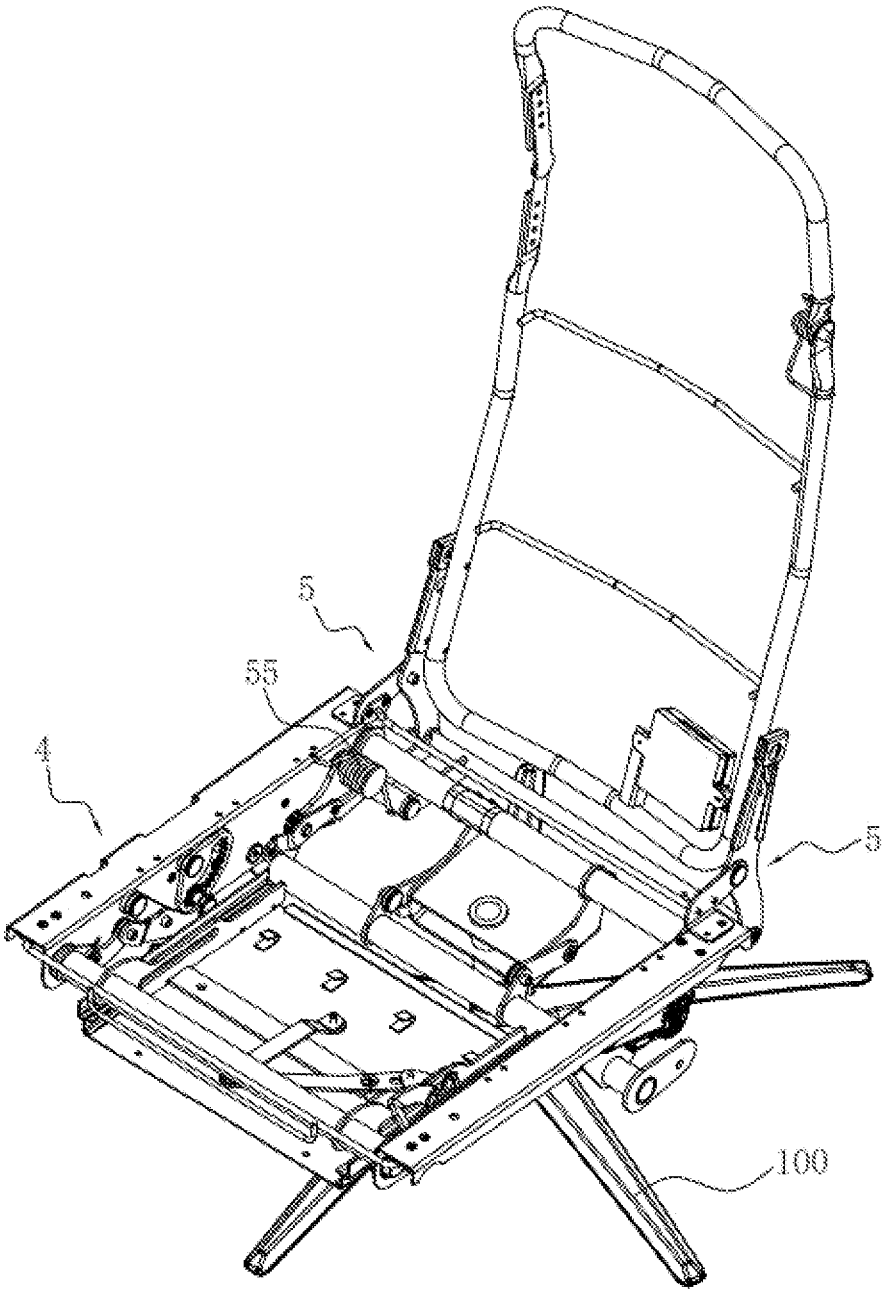
FIG. 16 is a schematic structural diagram of the fourth embodiment of the multifunctional iron frame of the present application viewed from another perspective.

Referring to FIGS. 15 and 16, this embodiment provides a seat, specifically a chair or a sofa, including a multifunctional iron frame according to Embodiment 1. A stand bar 100 is rotatably connected under the multifunctional iron frame, and the backrest mechanism 5 is connected to a backrest frame for supporting the back of a user. In this embodiment, the backrest drive shaft 6 driven by a motor is rotatably connected to the right seat frame 12 to drive and control the backrest mechanism 5. In other embodiments, it can also be connected to the left seat frame 11. For the convenience of assembling, the driving mechanism 2 and the linkage mechanism 4 are also installed on the right seat frame 12, or, alternatively, on the left seat frame 11 according to actual design needs. The driving mechanism 2 is used to drive the leg support mechanism 3 separately via the linkage mechanism 4. A reset component 55 is further provided on the backrest mechanism 5, for example, a torsion spring, configured to facilitate the reset of the backrest mechanism 5.

Embodiment 5

Figure 17:
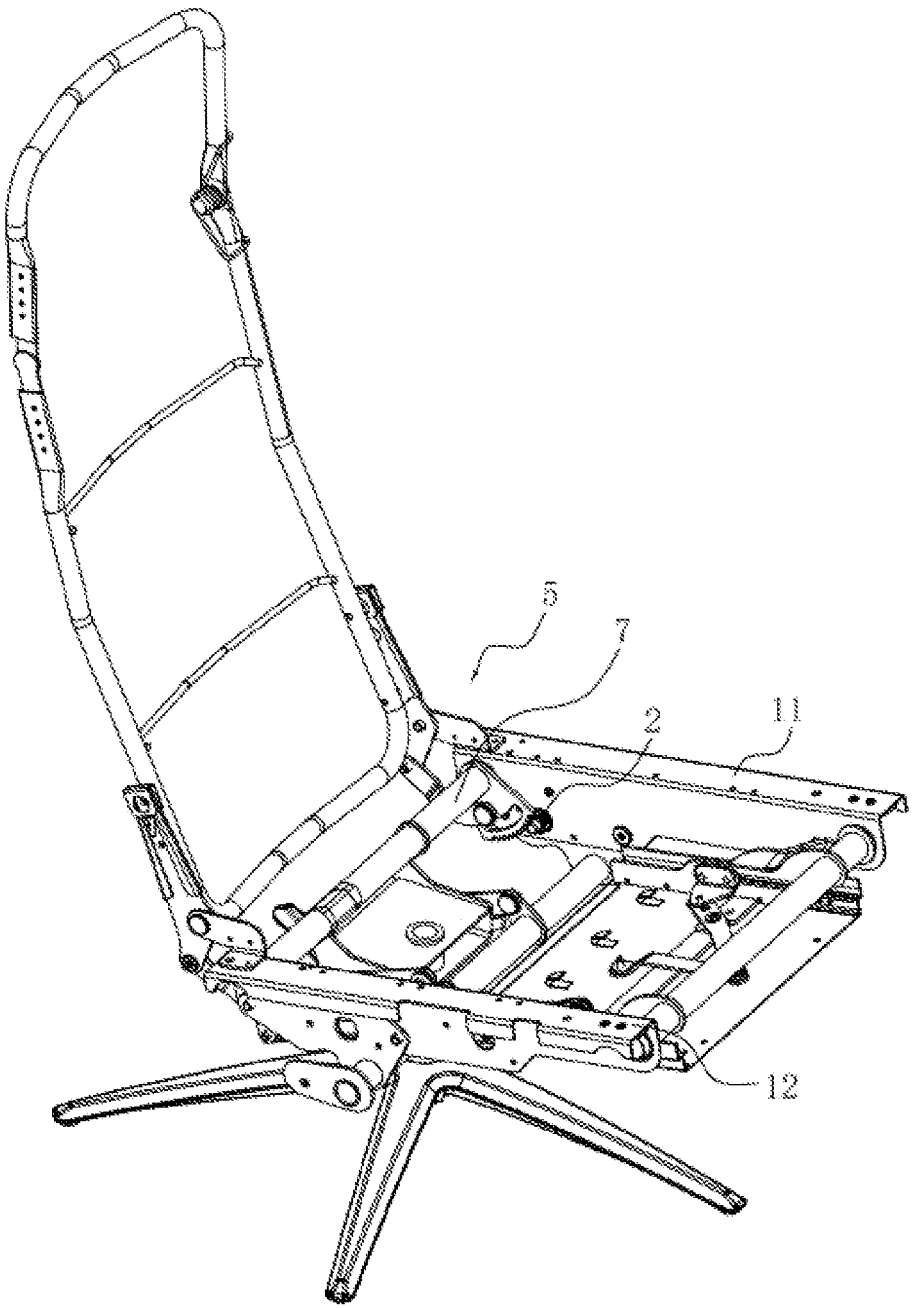
FIG. 17 is a schematic structural diagram of a fifth embodiment of the multifunctional iron frame of the present application.
Figure 18:
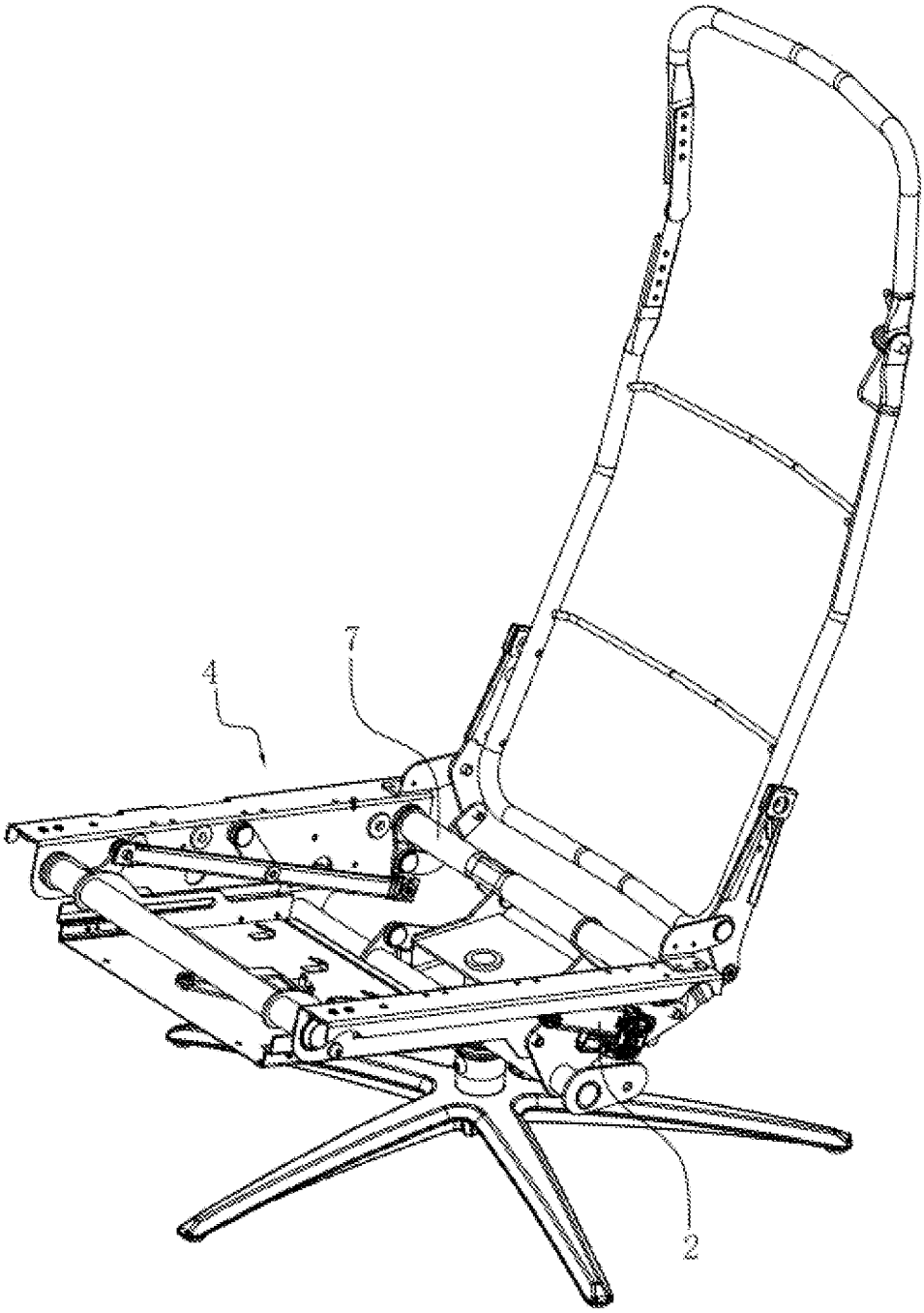
FIG. 18 is a schematic structural diagram of the fifth embodiment of the multifunctional iron frame of the present application viewed from another perspective.

Referring to FIGS. 17 and 18. This embodiment provides a seat, for example, a seat or sofa, differing from Embodiment 4 in that, it includes a multifunctional iron frame in Embodiment 2. In this embodiment, the driving mechanism 2 and backrest mechanism 5 are arranged on the left seat frame 11, the linkage mechanism 4 is arranged on the right seat frame 12, and the backrest mechanism 5 and linkage mechanism 4 are interconnected via the transmission shaft 7.

The above shows and describes the basic principles, main features, and advantages of the present application. Those skilled in the art should understand that the present application is not limited by the aforementioned embodiments. The aforementioned embodiments and instructions only illustrate the principles of the present application. Without departing from the spirit and scope of the present application, there may be various changes, modifications, substitutions, and variations of the present application, all of which fall within the scope of the claimed protection.

What is claimed is:

1. A multifunctional iron frame, comprising:

a seat frame;

a driving mechanism connected to the seat frame;

a leg support mechanism comprising a leg support skeleton and a support plate sliding relative to the leg support skeleton, wherein the leg support skeleton is rotatably connected to the seat frame;

a linkage mechanism connected between the driving mechanism and the leg support skeleton and pivotally connected to the seat frame, wherein the driving mechanism drives the leg support skeleton to rotate relative to the seat frame via the linkage mechanism; and a backrest mechanism, wherein the backrest mechanism comprises a backrest frame pivotally connected to the seat frame, the backrest mechanism is connected to the driving mechanism, the driving mechanism is configured to drive the backrest frame to rotate relative to the seat frame, and the linkage mechanism is connected between the backrest mechanism and the leg support skeleton, so as to enable the backrest frame and the leg support skeleton to rotate synchronously relative to the seat frame;

wherein the multifunctional iron frame has a sitting state, a lying state and an intermediate state between the sitting state and the lying state, the intermediate state is a state when the support plate is closest to a ground when being overturned outward from below the seat frame, when the multifunctional iron frame is rotated from the sitting state to the intermediate state, the leg support skeleton is rotated relative to the seat frame while the support plate does not slide relative to the leg support skeleton; and, when the multifunctional iron frame is rotated from the intermediate state to the lying state, the leg support skeleton is rotated relative to the seat frame and the support plate is slid relative to the leg support skeleton.

2. The multifunctional iron frame according to claim 1, further comprising a base and a seat frame adjusting mechanism, wherein the seat frame adjusting mechanism comprises a first rotating rod and a second rotating rod, two ends of the first rotating rod are pivotally connected to the driving mechanism and the base, respectively, and two ends of the second rotating rod are pivotally connected to the base and the seat frame, respectively, so that the base, the first rotating rod, the seat frame and the second rotating rod are sequentially connected to form a planar four-bar linkage mechanism.

3. The multifunctional iron frame according to claim 1, wherein a driving end of the driving mechanism is provided with a gear, the backrest mechanism further comprises a toothed plate engaged with the gear and a backrest connecting rod hinged with the toothed plate, the backrest frame is hinged with the backrest connecting rod, and the toothed plate is pivotally connected to the seat frame, so that the toothed plate, the backrest connecting rod and the backrest frame are sequentially connected to form a four-bar linkage mechanism.

4. The multifunctional iron frame according to claim 1, wherein the leg support mechanism further comprises a first leg support connecting rod fixedly connected to the leg support skeleton and a second leg support connecting rod hinged to the first leg support connecting rod, and the second leg support connecting rod is hinged to the linkage mechanism.

5. The multifunctional iron frame according to claim 4, wherein the linkage mechanism comprises a connecting rod and a rotating rod, the rotating rod is pivotally connected to the seat frame, a middle portion of the connecting rod is hinged with the rotating rod, and two ends of the connecting rod are rotatably connected to the second leg support connecting rod and the backrest mechanism, respectively.

6. The multifunctional iron frame according to claim 4, wherein the leg support mechanism further comprises an eccentric connecting rod and a connecting rod assembly, a first end of the eccentric connecting rod is hinged with the seat frame, a second end of the eccentric connecting rod is connected to the connecting rod assembly and slidingly connected with the leg support skeleton, and the connecting rod assembly is hinged with the support plate.

7. The multifunctional iron frame according to claim 6, wherein the connecting rod assembly comprises a slider rotatably connected to the eccentric connecting rod, a first connecting rod connected to the slider, and a second connecting rod hinged with the first connecting rod, the second connecting rod is hinged with the support plate, and the first connecting rod is pivotally connected to the leg support skeleton.

8. The multifunctional iron frame according to claim 7, wherein the first connecting rod is provided with a connecting rod sliding groove, a first end of the slider is rotatably connected to the eccentric connecting rod, and a second end of the slider is configured to slide along the connecting rod sliding groove.

9. A seat, comprising the multifunctional iron frame according to claim 1.

* * * * *